US006328812B1

(12) United States Patent
Huang

(10) Patent No.: US 6,328,812 B1
(45) Date of Patent: Dec. 11, 2001

(54) PIPELINE-CLEANING METHOD AND DEVICE THEREOF

(76) Inventor: Ta-Hsin Huang, No. 24, Alley 1, Lane 727, Chia-Chang Rd., Nan-Tzu Dist., Kaohsiung City (TW)

( * ) Notice: Subject to any disclaimer, the term of this patent is extended or adjusted under 35 U.S.C. 154(b) by 0 days.

(21) Appl. No.: 09/433,785

(22) Filed: Nov. 3, 1999

(51) Int. Cl.[7] ..... B08B 7/00; B08B 9/04; B08B 9/00; B08B 9/03; B08B 3/00

(52) U.S. Cl. ..... 134/7; 134/8; 134/22.1; 134/22.11; 134/22.12; 134/103.1; 134/195; 134/196

(58) Field of Search ..... 134/7, 8, 22.1, 134/22.11, 22.12, 103.1, 195, 196

(56) References Cited

U.S. PATENT DOCUMENTS 1,056,696 * 3/1913 Laidley .
1,121,308 * 12/1914 Thomas .
1,149,164 * 8/1915 Richter .
1,887,722 * 11/1932 Schoener et al. .
1,896,004 * 1/1933 Lewis et al. .
1,979,147 * 10/1934 Dobbelmann et al. .
2,011,323 * 8/1935 Remick .
2,016,926 * 10/1935 Josepowitz .
2,029,232 * 1/1936 Green .
2,030,398 * 2/1936 Rivard et al. .
2,087,694 * 7/1937 Malmros .
2,089,597 * 8/1937 Carter .
3,618,621 * 11/1971 Nordegren ..... 134/57
4,971,087 * 11/1990 Benedetti et al. ..... 134/104.1
5,090,079 * 2/1992 Allison et al. ..... 15/104.31
5,244,505 * 9/1993 Allison et al. ..... 134/22.11
5,405,452 * 4/1995 Anderson et al. ..... 134/22.12
5,680,877 * 10/1997 Edstrand et al. ..... 134/103.1
5,795,402 * 8/1998 Hargett, Sr. et al. ..... 134/8
5,911,255 * 6/1999 Bond ..... 15/3.52
6,082,378 * 7/2000 Schef ..... 134/8
6,174,381 * 1/2001 Ignatiev et al. ..... 134/8
6,227,215 * 5/2001 Akazawa ..... 134/169 C

* cited by examiner

*Primary Examiner*—Randy Gulakowski
*Assistant Examiner*—Yolanda E. Wilkins
(74) *Attorney, Agent, or Firm*—Birch, Stewart, Kolasch & Birch, LLP

(57) ABSTRACT

A pipeline-cleaning method and device thereof is built and applied by firstly forming a sealing circuit including a pipeline pending cleaning, a pressure control device, and two units of pipeline-cleaning device A, A'. A storage tank filled with rigid granules in each pipeline-cleaning device A, A' is provided with a filter net unit at its lower portion and a filter unit at its upper portion. When cleaning, a pressurized liquid is supplied by the pressure control device to drive the granules circulating the circuit and thereby remove dirt and sediment deposited on the pipe wall by collision and rubbing of the granules to the pipeline inner wall.

2 Claims, 6 Drawing Sheets

PIPELINE-CLEANING METHOD AND DEVICE THEREOF

BACKGROUND OF THE INVENTION

This invention relates to a pipeline-cleaning method and device thereof for removing foreign dirt or sediment efficiently in pipelines.

For dissolving and removing tenacious dirt in pipelines, various dissolvent lotions have been used often in the conventional cleaning methods to draw only limited efficacy with an accompanied side effect of pipeline corrosion to frequently result in aftereffects of pollution.

In view of abovesaid imperfection, after years of constant effort in research, the inventor had invented a means (U.S. Pat. No. 5,941,082) which points to clean the dirt or sediment within the pipelines of an air conditioner. Still, particles, formed by the dirt and sediment which is washed out from the pipelines, remain moving around in said means, being unable to capture the particles in a filter unit of said means, causing a lower efficiency indeed.

However, in order to overcome the aforesaid drawback of the prior invention, the inventor has consequently developed and proposed this improved method and device pertaining as to easily clean the dirt and sediment within pipelines.

SUMMARY OF THE INVENTION

This invention is proposed to eliminate abovesaid imperfection and provide a pipeline-cleaning method and device thereof which is built and applied by firstly forming a sealing circuit including a pipeline pending cleaning, a pressure control device, and two units of pipeline-cleaning device. A storage tank filled with rigid granules in each pipeline-cleaning device is provided with a filter net unit at its lower portion and a filter unit at its upper portion. When cleaning, a pressurized liquid is supplied by the pressure control device to drive the granules circulating the circuit and thereby remove dirt and sediment deposited on the pipe wall by collision and rubbing of the granules to the pipeline inner wall.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
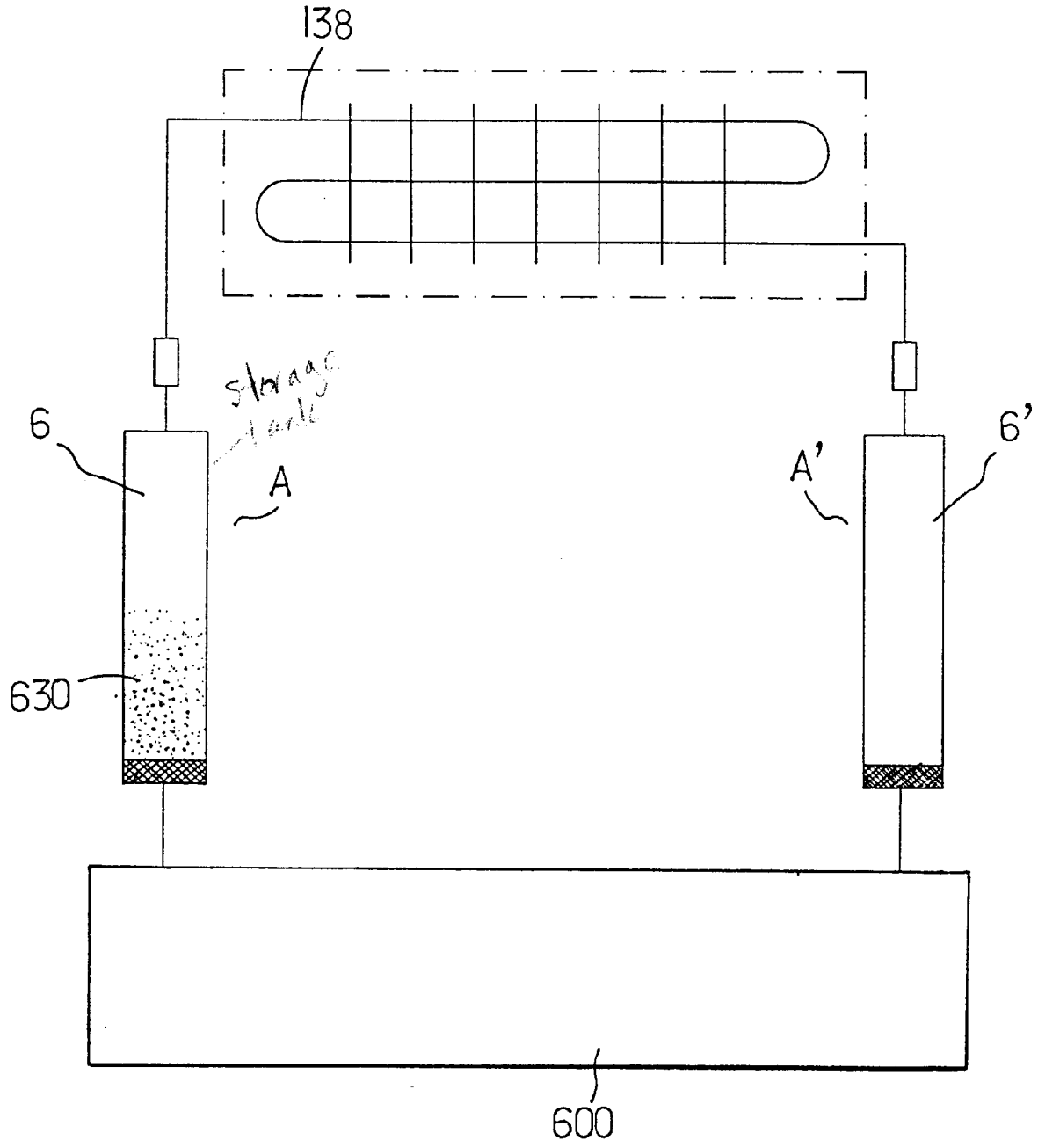
FIG. 1 is a block diagram of a pipeline-cleaning device of this invention.
Figure 2:
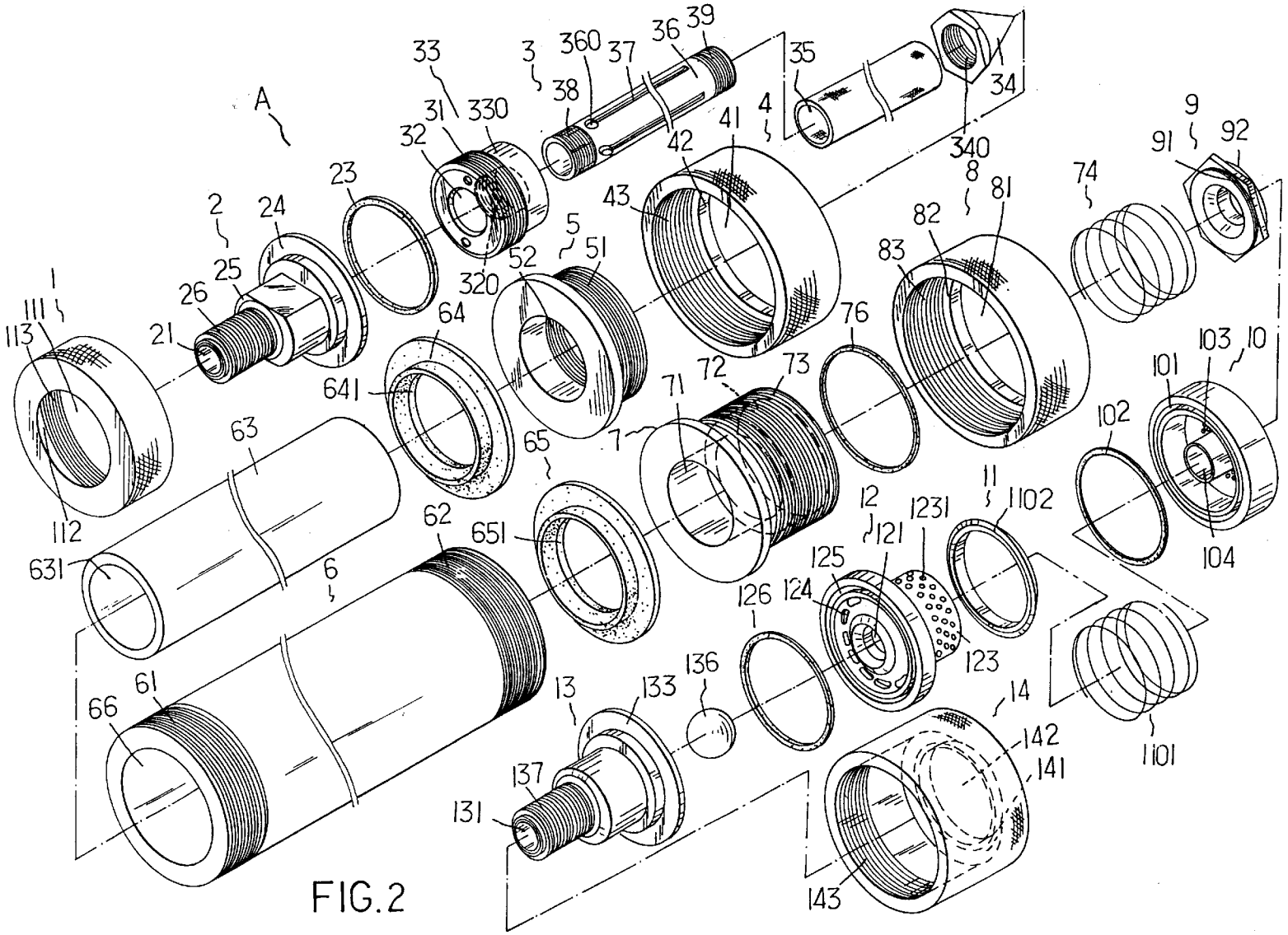
FIG. 2 is a three-dimensional exploded view of the pipeline-cleaning device of this invention.

As shown in FIG. 1, 2, a sealed circuit is built by disposing two units of pipeline-cleaning device between a pipe coupling (not shown) and a coupling of pressure-control device (not shown). The pipeline-cleaning device A comprises a storage tank 6 and a filter net unit located at a lower part and a filter unit at an upper part thereof.

The filter net unit further comprises a lower minor cap 1, a pipe coupling 2, a filter rod 3, a lower major cap 4, and a T-shape lower seat 5.

The lower minor cap 1 having a center through hole 111 is provided with a flange 112 at one end of the through hole 111, and an internal thread 113 at the other for screw-coupling with an external thread 51 of the T-shape lower seat 5.

The pipe coupling 2 in T-shape having a center through hole 21, wherein an circular groove 22 (not shown) is disposed at its right end for loading a leakage-proof washer 23; the right end is a plane body with a wider upper rim 24 for pressing against the flange 112 when the pipe coupling 2 is inserted to joint with the lower minor cap 1; a middle segment 25 of the pipe coupling 2 is offered with two center plane faces and two lateral spherical faces; and an external thread 26 formed at a lower end of the pipe coupling 2 is for screw-jointing with a pipeline 138 pending cleaning.

The filter rod 3 is composed of a screw-joint body 33, a rod body 36, and a nut 34, wherein the screw-joint body 33 comprises an external thread 31 at left side of its circumference screw-jointed with an internal thread 52 at right end of the T-shape lower seat 5, a circular smooth face 330 with a shorter diameter than that of the left external thread 31 at its right side, a center through bole 32 formed inside, an internal thread 320 at its right end for screw-jointing with an external thread 38 at left side of the rod body 36, which comprises a plurality of through holes 360 distributed around its circumference adjacent to the external thread 38 at its left end, a plurality of channel 37 formed in center portion along axial direction, the external thread 38 at its left end and an external thread 39 at its right end for screw-jointing with the internal thread 320 of the screw-joint body 33 and an internal thread 340 of the nut 34 respectively; the rod body 36 is clothed in a filter net 35; the conic nut 34 having the internal thread 340 formed at its bottom end is screw-jointed with the external thread 39 on the rod body 36.

The lower major cap 4 having a center through hole 41, a flange 42 at its one end, and an internal thread 43 at the other is screw-jointed with a left end of the storage tank 6.

The T-shape lower seat 5 having an external thread 51 at its right end for screw-jointing with the lower minor cap 1, wherein a center through hole is tapered toward its right end where an internal thread 52 is formed for coupling with the external thread 31 of the screw-joint body 33 of the filter rod 3.

The storage tank 6 in shape of a hollow cylinder 66 is female-jointed to a cylindrical body 63 in shape of a hollowed cylinder 631 for the filter rod 3 to penetrate and reside therein, and in both respective openings of the cylindrical body 63, a leakage-proof washer 64, 65 with a flange 641, 651 is inserted for preventing leakage of inside liquid. Further, an external thread 61, 62 is formed at two outer ends of the storage tank 6 respectively for screw-jointing with the lower major cap 4 and an upper major cap 8.

The filter unit comprises a T-shape upper seat 7, the upper major cap 8, an anti-reverse piece 9, a filter socket 10, an anti-reverse ring 11, a filter 12, a pipe coupling 13, and an upper minor cap 14.

The T-shape upper seat 7 is composed of a center through hole 71 extended rightward to form a receptacle space 72 for placing an elastic element 74, an circular groove 75 formed at an inner portion of its right end for female-jointing with a leakage-proof 76, and an external thread 73 formed at an outer face of its right end for screw-jointing an internal thread 143 of the upper minor cap 14.

The upper major cap 8 contains a center through hole 81 having a flange 82 at one end and an internal thread 83 at the other for screw-jointing with the right end of the storage tank 6.

The anti-reverse piece 9, a polygonal body, is provided with a circularly threaded groove 91 for holding the elastic element 74 placed thereon and a recessed plane 92 at its right end.

The filter socket 10 is formed with a circular groove 101 for collaring a leakage-proof washer 102, a plurality of small through holes 103 disposed staggeringly and circularly in middle portion at its right end for filtering out bigger granules of varia, and a protruded center through hole 104 for female-jointing with a center through hole 121 of the filter 12.

The anti-reverse ring 11 in conic shape is formed with a circularly threaded groove 110 in its outer right side for retaining an elastic element 1101, and a conic ring body 1102 at its left end for choking a plurality of relatively bigger through holes 124 to prevent the filtered out varia and sediment from leaking through the same.

The filter 12 is formed with an internal center through hole 121, which is extended rightward to form a protrusive body 123 with a plurality of small through holes 1231 disposed in cylindrical face thereof, the plurality of circularly arranged bigger through holes 124 in an inner rim of the filter 12, and a circular groove 125 recessively disposed at its left side for female-mounting a leakage-proof washer 126.

The pipe coupling 13 in T-shape is formed with a center through hole 131, which is extended rightward to form four protruded pillars 132 with a respective valley 1321 for pressing against an anti-reverse ball 136. The pipe coupling 13 is tapered rightward (downward) to form a coupling body with a wider upper part and a narrower lower part, and when it is coupled with the upper minor cap 14, a wider upper rim 133 of the pipe coupling 13 can just press against a flange 141 of the upper minor cap 14. Moreover, an external thread 137 is formed at an upper (left) end on the pipe coupling 13 for screw-jointing with a pipeline 138 pending cleaning.

The upper minor cap 14 is formed with a center through hole 142, a flange 141 at right end of the through hole 142, and an internal thread 143 at its left end for screw-jointing with the external thread 73 on the T-shape upper seat 7.

Figure 3:
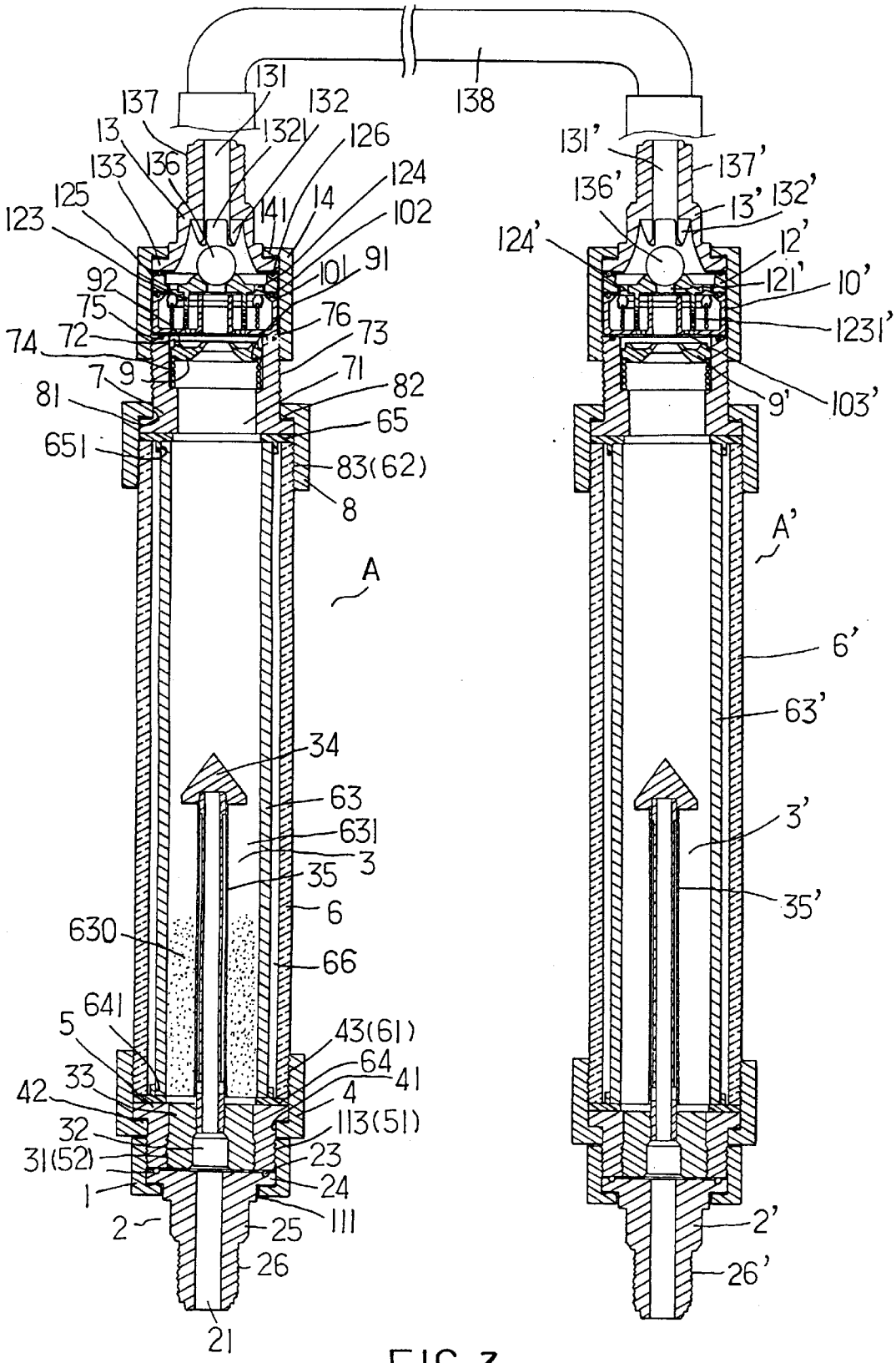
FIG. 3 is a cutaway sectional view of the assembled pipeline-cleaning device of this invention.
Figure 4:
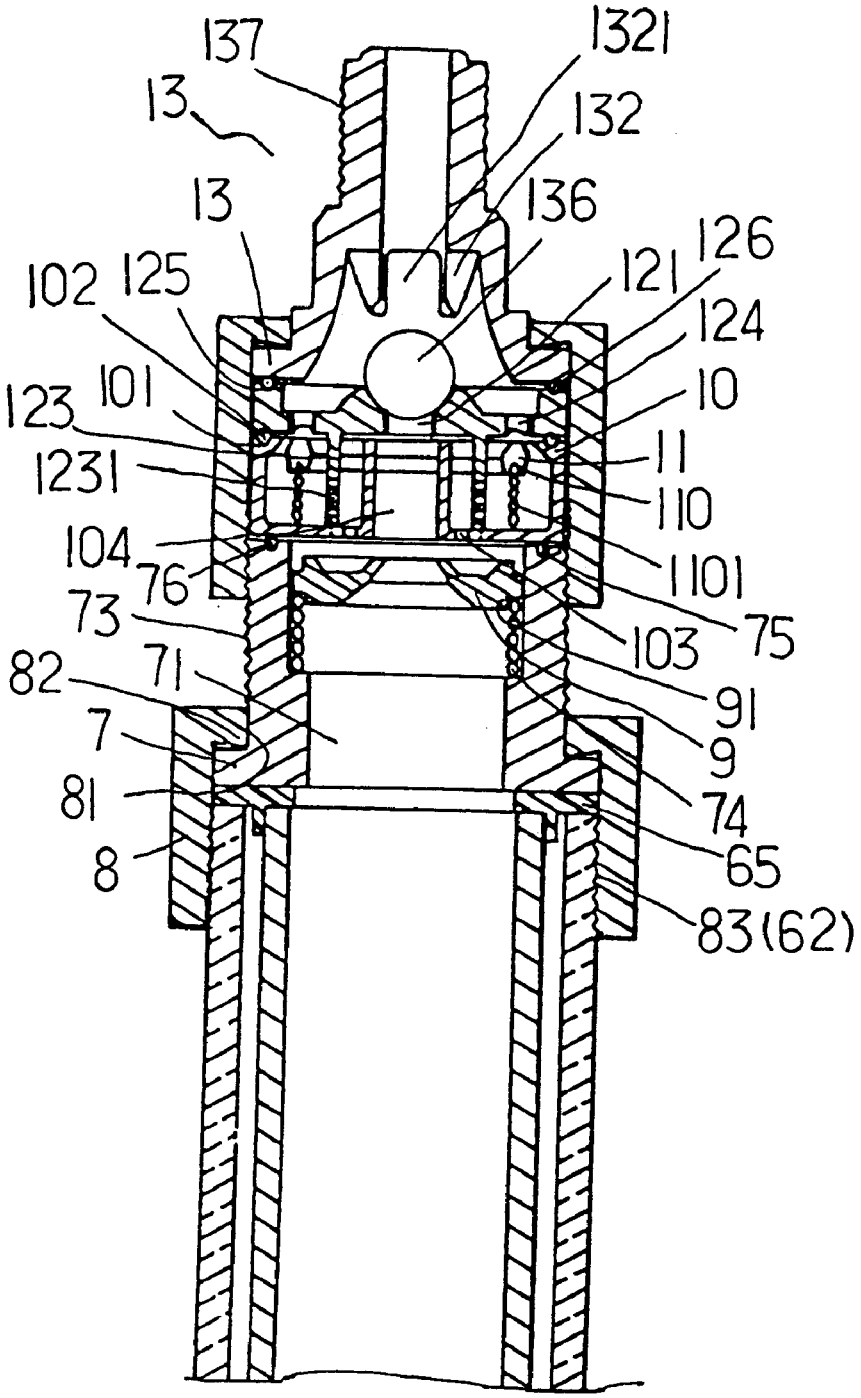
FIG. 4 is an assembled enlarged view of a filter unit of this invention.
Figure 5:
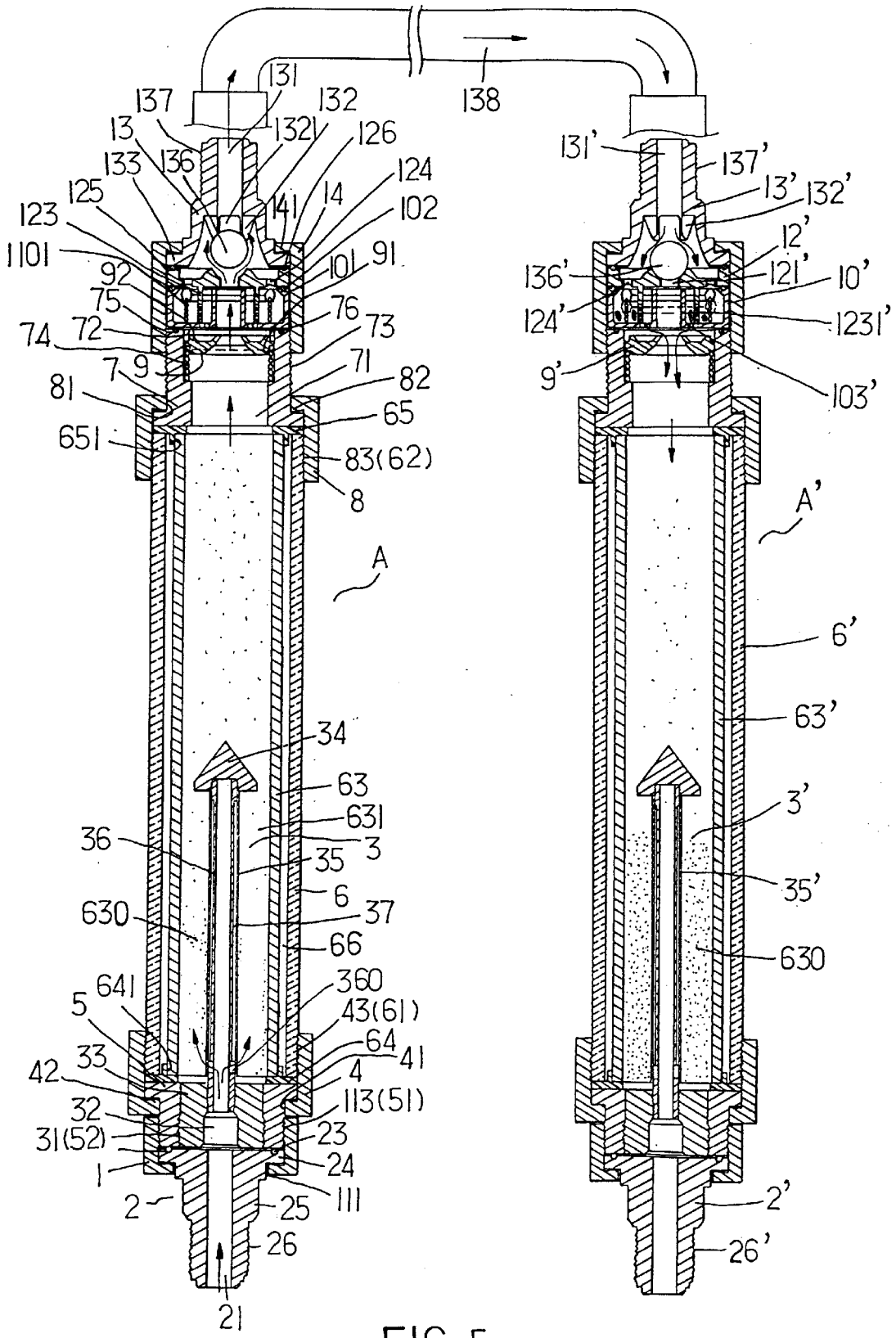
FIG. 5 is a schematic view of cleaning operation of the pipeline-cleaning device of this invention.
Figure 6:
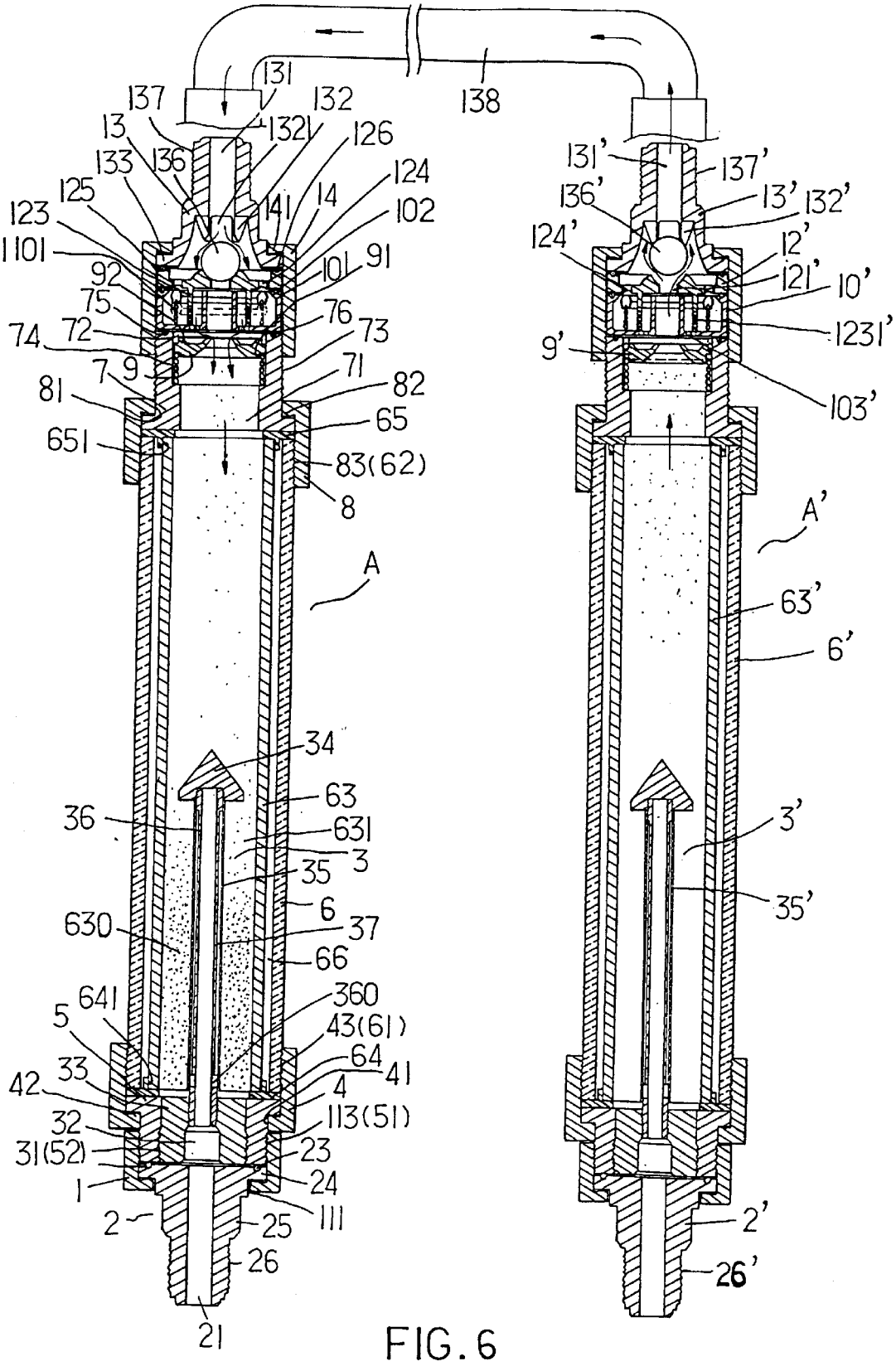
FIG. 6 is a schematic view showing one more time cleaning operation of the pipeline-cleaning device of this invention.

When assembling, referring to FIG. 3, 4, the procedure is to:

plug the cylindrical body 63 in the storage tank 6, insert the flange 641, 651 of the leakage-proof washer 64, 65 in respective end of the cylindrical body 63; plug the lower seat 5 in the lower major cap 4 and screw the internal thread 43 of the lower major cap 4 on the external thread 61 to lock the lower seat 5 at the left end of the cylindrical tank 6; plug the T-shape upper seat 7 in the upper major cap 8 and screw the internal thread 83 of the upper major cap 8 on the external thread 62 of the cylindrical tank 6 to lock the T-shape upper seat 7 at the right end of the cylindrical tank 6; collar the leakage-proof washer 76 in the circular groove 75 of the T-shape upper seat 7 to have the assembly of the cylindrical tank 6 completed; then, load the leakage-proof washer 23 onto the circular groove 22 of the pipe coupling 2, then, place the pipe coupling 2 in the through hole 111 of the lower minor cap 1; plug the rod body 36 of the filter rod 3 in the filter net 35 and lock it tightly with the nut 34; place the filter rod 3 in the lower major cap 4, then, screw the external thread 31 of the screw-joint body 33 to joint with the internal thread 52 of the T-shape lower seat 5; screw the external thread 51 of the T-shape lower seat 5 to joint with the internal thread 113 of the lower minor cap 1 to have the assembly of the filter net unit completed; then, load the elastic element 74 in the circularly threaded groove 91 of the anti-reverse piece 9 and plug it in the receptacle space 72 of the T-shape upper seat 7; load another elastic element 1101 in the circularly threaded groove 110 of the anti-reverse ring 11 and place it in the filter socket 10; load the leakage-proof washer 102 in the circular groove 101 and place the filter 12 on the filter socket 10, then, dispose the leakage-proof washer 126 in the circular groove 125 of the filter 12; moreover, lay the anti-reverse ball 136 on the through hole 121 of the filter 12, collar the upper minor cap 14 onto the pipe coupling 13, and couple the internal thread 143 of the upper minor cap 14 with the external thread 73 of the T-shape upper seat 7 to have the assembly of the filter unit completed, and so have the pipeline-cleaning device A done.

When cleaning operation of pipeline is desired, the external threads 26, 26', 37, 137' by end of the pipe couplings 2, 2' 13, 13' of the pipeline-cleaning devices A, A' are firstly screw-jointed with a pressure-control device 600 and a pipeline 138 pending cleaning. The cleaning procedure (referring to FIG. 1, 5) is described as the following:

1. A pressurized liquid from the pressure-control device 600 enters the through hole 21 of the pipe coupling 2 of the filter net unit and flows through the through hole 32 of the screw-joint body 33 of the filter rod 3, then, flows out of the through hole 360 by the left end of the rod body 36 to enter the storage tank 6. When the liquid leaves the storage tank 6 to flow into the filter unit, because the anti-reverse piece 9 blocks the through hole 103 of the filter socket 10, the granules 630 in the cylindrical body 63 of the pipeline-cleaning device A is forced to flow through the center through hole 104 in the filter socket 10, then the through hole 121 in the filter 12 to lift and push the anti-reverse ball 136 against the top ends of those four protruded pillars 132 so that the granules 630 is allowed to enter the pipeline 138 to remove the dirt and sediment deposited on the pipe wall by collision and rubbing.

2. The granules 630 is now driven to enter another pipeline-cleaning device A'. After entering a through hole 131' of a pipe coupling 13' and passing through a channel surrounded by four protruded pillars 132', the granules 630 is forced to take a way through a plurality of bigger through holes 124' arranged in an rim of a filter 12' to enter the filter 12' because of blocking of a center through hole 121' of the filter 12' by an anti-reverse ball 136'. The granules 630 will then pass through a plurality of small through holes 1231' and small through holes 103' in a filter socket 10', then push an anti-reverse piece 9' open to enter another storage tank 6' of the other pipeline-cleaning device A' to be detained in a cylindrical body 63' of the other storage tank 6' by a filter net 35' enclosing a filter rod 3'. The removed dirt and sediment with a grain size bigger than the small through hole 1231' of the filter 12' and the small through hole 103' of the filter socket 10' will be detained in the filter unit while the rest with a grain size smaller than mesh size of the filter net 35' will accompany the liquid to return back to the pressure-control device 600.

3. At this time, the pressure-control device 600 supplies pressurized liquid to the pipeline-cleaning device A' in a reverse direction for cleaning the pipeline 138 and vice versa repeatedly until it is thoroughly cleaned.

What is claimed is:

1. A pipeline-cleaning device A, having a storage tank filled with some rigid granules, which comprises a filter net unit disposed at its lower portion with a filter net in mesh size smaller than the granules and a filter unit disposed at its upper portion, being connected with pipe couplings, couplings of a pressure control device, and a second pipeline-cleaning device A' to form a sealed circuit, in which the filter net unit comprises:

a lower minor cap having a center through hole with a flange at its one end and an internal thread at the other for screw-coupling with an external thread of a T-shape lower seat;

a pipe coupling in T-shape having a center through hole, wherein an circular groove is disposed at its right end for loading a leakage-proof washer; the right end is a plane body with a wider upper rim for pressing against the flange when said pipe coupling is inserted to joint with said lower minor cap; a middle segment of said pipe coupling is offered with two center plane faces and two lateral spherical faces; and an external thread formed at a lower left end of said pipe coupling is for screw-jointing with a pipeline pending cleaning;

a filter rod composed of a screw-joint body, a rod body, and a nut, wherein said screw-joint body further comprises an external thread at a left side of its circumference screw-jointed with an internal thread at a right end of said T-shape lower seat, a circular smooth face with a shorter diameter than that of said left external thread at its right side, a center through hole formed inside, an internal thread at its right end for screw-jointing with an external thread at the left side of said rod body, which comprises a plurality of through holes distributed around its circumference adjacent to said external thread at its left end, a plurality of channel formed in center portion along axial direction, said external thread at its left end and an external thread at its right end for screw-jointing with said internal thread of said screw-joint body and an internal thread of said nut respectively; said rod body is clothed in a filter net; said conic nut having said internal thread formed at its bottom end is screw-jointed with said external thread on said rod body;

a lower major cap having a center through hole, a flange at its one end, and an internal thread at the other is screw-jointed with a left end of said storage tank;

the T-shape lower seat having an external thread at its right end for screw-jointing with said lower minor cap, wherein a center through hole is tapered toward its right end where an internal thread is formed for coupling with said external thread of said screw-joint body of said filter rod; and the storage tank in shape of a hollow cylinder is female-jointed to a cylindrical body in shape of a hollowed cylinder for said filter rod to penetrate and reside therein, and in both respective openings of said cylindrical body, a leakage-proof washer with a flange is inserted for preventing leakage of inside liquid, an external thread is formed at two outer ends of said storage tank respectively for screw-jointing with said lower major cap and an upper major cap;

the filter unit comprises:

a T-shape upper seat composed of a center through hole extended rightward to form a receptacle space for placing an elastic element, an circular groove formed at an inner portion of its right end for female-jointing with a leakage-proof, and an external thread formed at an outer face of its right end for screw-jointing an internal thread of an upper minor cap;

the upper major cap containing a center through hole having a flange at one end and an internal thread at the other for screw-jointing with the right end of said storage tank;

an anti-reverse piece being a polygonal body provided with a circularly threaded groove for holding said elastic element placed thereon and a recessed plane at its right end;

a filter socket formed with a circular groove for collaring a leakage-proof washer, a plurality of small through holes disposed staggeringly and circularly in middle portion at its right end for filtering out bigger granules of varia, and a protruded center through hole for female-jointing with a center through hole of a filter;

an anti-reverse ring in conic shape formed with a circularly threaded groove in its outer right side for retaining an elastic element, and a conic ring body at its left end for choking a plurality of relatively bigger through holes to prevent the filtered out dirt and sediment from leaking through the same;

the filter formed with an internal center through hole, which is extended rightward to form a protrusive body with a plurality of small through holes disposed in cylindrical face thereof, the plurality of circularly arranged bigger through holes in an inner rim of said filter, and a circular groove recessively disposed at its left side for female-mounting a leakage-proof washer;

a pipe coupling in T-shape formed with a center through hole, which is extended rightward to form four protruded pillars with a respective space for pressing against an anti-reverse ball, said pipe coupling tapered downward to form a coupling body with a wider upper part and a narrower lower part, and an external thread formed at an upper left end on the pipe coupling for screw-jointing with said pipeline pending cleaning; and when it is coupled with said upper minor cap, a wider upper rim of said pipe coupling which will press against a flange of said upper minor cap; and the upper minor cap formed with a center through hole, said flange at right end of said through hole, and an internal thread at its left end for screw-jointing with said external thread on said T-shape upper seat.

2. A method of pipeline-cleaning by firstly screw-jointing a plurality of external threads of pipe couplings of two pipeline-cleaning devices with a pressure control system and a pipeline pending cleaning, the cleaning procedure thereof comprising:

supplying a pressurized liquid by said pressure-control device to enter a through hole of a pipe coupling of a filter net unit and flow through a through hole of a screw-joint body of a filter rod, then flow out of a through hole by a left end of a rod body to enter a storage tank;

forcing granules in a cylindrical body of a pipeline-cleaning device A to flow through a center through hole in a filter socket when the liquid leaves the storage tank to flow into a filter unit, because an anti-reverse piece blocks a through hole of said filter socket;

lifting and pushing an anti-reverse ball against top ends of four protruded pillars by the flowing liquid itself when the liquid flows through a through hole in a filter so that the granules can enter a pipeline pending cleaning to remove dirt and sediment deposited on the pipe wall by collision and rubbing;

driving the granules by the liquid to enter another pipeline-cleaning device A'; and after entering a through hole of a pipe coupling and passing through a channel surrounded by four protruded pillars, the granules is forced to take a way through a plurality of bigger through holes arranged in an rim of a filter to enter said filter because of blocking of a center through hole of said filter by an anti-reverse ball;

allowing the granules to pass through a plurality of small through holes and small through holes in a filter socket, then push an anti-reverse piece open to enter another storage tank of said pipeline-cleaning device A' to be detained in a cylindrical body of said storage tank by a filter net enclosing a filter rod;

detaining the removed dirt and sediment with a grain size bigger than said small through hole of said filter and the small through hole of the filter socket in the filter unit while the rest with a grain size smaller than mesh size of a filter net will accompany the liquid to return back to said pressure-control device; and supplying pressurized liquid by said pressure-control device to said pipeline-cleaning device A' in a reverse direction for cleaning said pipeline and vice versa repeatedly until it is thoroughly cleaned.

* * * * *